United States Patent [19]

Yoshinaga et al.

[11] Patent Number: 4,496,671

[45] Date of Patent: Jan. 29, 1985

[54] CONTINUOUS CARBON FILAMENT FIBER BUNDLES

[75] Inventors: Minoru Yoshinaga; Atsushi Sumida, both of Ehime, Japan

[73] Assignee: Toray Industries, Inc., Tokyo, Japan

[21] Appl. No.: 396,065

[22] Filed: Jul. 7, 1982

[30] Foreign Application Priority Data

Jul. 14, 1981 [JP] Japan ..... 56-108862

[51] Int. Cl.[3] ..... C08K 9/00; B32B 9/00

[52] U.S. Cl. ..... 523/206; 428/367; 428/375; 428/408; 523/468; 523/512; 524/495

[58] Field of Search ..... 428/364, 367, 375, 408, 428/413; 523/468, 512, 456, 402; 524/495

[56] References Cited

U.S. PATENT DOCUMENTS 3,839,252 11/1974 Boss et al. ..... 523/402
3,931,116 1/1976 Bernstein et al. ..... 523/456
4,169,210 1/1978 Schimmel ..... 523/402

FOREIGN PATENT DOCUMENTS 2752255 6/1978 Fed. Rep. of Germany ..... 523/456
0547463 2/1977 U.S.S.R. .

*Primary Examiner*—Marion McCamish
*Assistant Examiner*—Beverly K. Johnson
*Attorney, Agent, or Firm*—Austin R. Miller

[57] ABSTRACT

A bundle of continuous carbon filament fibers treated with a sizing agent containing as an active component a water-dispersible resin composition consisting of about 65% to 95% by weight of water-dispersible urethane compound having at least one epoxy group and at least one quaternary ammonium group and about 5% to 35% by weight of an epoxy resin. The bundle has an excellent fretting resistance, is extremely handleable, and produces a carbon fiber-reinforced composite material having excellent physical properties.

12 Claims, No Drawings

CONTINUOUS CARBON FILAMENT FIBER BUNDLES

The invention relates to a bundle of continuous carbon filament fibers having an excellent fretting resistance, i.e., the occurrence of fluffs and yarn breakage at subsequent processing stages is rare, and having a low moisture absorption property.

Carbon fibers are widely used in the manufacture of aircraft parts, space devices, precision machines, transport devices, sporting goods, atomic power supplies, and the like, because of their excellent mechanical properties, such as specific strength, specific modulus, and chemical resistance. In the manufacture of the above-mentioned items, carbon fibers are seldom used for textile material but are generally used for reinforcing material for metals, ceramics, synthetic resins, and the like. In particular, carbion fiber-reinforced plastics (hereinafter referred to as CFRPs) having synthetic resins as a matrix are widely used in various fields in view of the versatility, uniformity in performance, and cost of the resultant products.

It is important, in order to satisfactorily utilize the excellent properties of the carbon fibers in CFRPs, to ensure integral adhesion or binding between the carbon fibers and the matrix resin and, thus, the surface of the carbon fibers is generally activated by substituting the carbon fibers to a surface treatment, such as a vapor phase or liquid phase oxidizing treatment inclusive of an electrolytic treatment. It is necessary that the carbon fibers be further subjected to treatment with a sizing agent in order to improve the processing ability of the carbon fiber strands and to prevent the occurence of fluffs and yarn breakage in the carbon fiber strands due to the contact thereof with rollers and guides during the production of the carbon fiber strands or in the course of filament winding and the like. In particular, in the sizing treatment, in addition to the above-mentioned improvement in processing ability and the prevention of fluffs and yarn breakage, it is desirable to ensure that fluffs and yarn breakage also do not occur in the carbon fiber strands during subsequent processing stages and to impart a softness to the strands, thus making the strands more handleable without deteriorating the adhesiveness of the carbon fibers and the matrix resin.

For this purpose, various sizing agents have hitherto been proposed for carbon fibers. However, sizing agents using an organic solvent are not always practically desirable from the viewpoint of flammability or toxicity although they usually have excellent stability. Another class of sizing agents consists of aqueous dispersion sizing agents. However, some aqueous dispersion sizing agents are generally not practically usable since they have a short pot life while other aqueous dispersion sizing agents have a relatively long pot life but their moisture absorption property often deteriorates the properties of the resultant carbon fiber-reinforced composite material.

We have made extensive studies concerning the above-mentioned drawbacks of conventional sizing agents and carbon fibers treated with such sizing agents and have attained carbon fibers bundles not having such drawbacks.

Thus, it is an object of the present invention to provide a bundle of continuous carbon filament fibers having an excellent adhesiveness in respect to matrix resins and being extremely handleable and, in addition, having an excellent fretting resistance or high filament winding (FW) strength, i.e. the occurence of fluffs and yarn breakage is rare at subsequent processing stages, particularly during the forming of rotationally shaped articles or prepregs.

It is another object of the present invention to provide a bundle of continuous carbon filament fibers having a very excellent fretting resistance in subsequent processing stages, such as a filament winding process, in which the carbon fiber bundle passes through steps wherein the bundle is inevitably brought into contact with guides or rollers.

It is a further object of the present invention to provide a carbon fiber-reinforced composite material comprising an excellent bundle of continuous carbon filament fibers.

The present invention thus provides a bundle of continuous carbon filament fibers treated with a sizing agent containing as an active component a water-dispersible resin composition consisting of about 65% to 95% by weight of a water-dispersible urethane compound having at least one epoxy group and about 5% to 35% by weight of an epoxy resin.

The carbon fibers usable for the present invention may be produced by various known processes. Examples of the carbon fibers include carbon filament fiber bundles or tows consisting of monofilaments having a diameter of about 5 to 20 $\mu$m and having a strand tensile strength of 100 to 500 kg/mm$^2$, preferably carbon filament fiber bundles consisting of 500 to 50,000 monofilaments having a diameter of about 5 to 8 $\mu$m and having a strand tensile strength of 200 to 500 kg/mm$^2$, obtained from precursor fibers made of rayon, acrylonitrile polymers, petroleum pitch, or the like.

According to one feature of the present invention, the carbon filament fiber bundle is treated with the above-defined sizing agent so that an epoxy-modified polyurethane obtained from the urethane and epoxy resin mixture is deposited on the surface, thereby imparting to the treated carbon filament fiber bundle an excellent FW strength, i.e. fretting resistance, and making it extremely handleable.

Examples of the water-dispersible urethane compound having at least one epoxy group and at least one quaternary ammonium group may include compounds obtained by reacting one or more organic compounds selected from the group consisting of (1) compounds having quaternary ammonium and hydroxyl groups, (2) compounds having epoxy and hydroxyl groups, and (3) polyesters, polyethers, and polyesterethers having one or more hydroxyl groups with a polyisocyanate compound in any desired order. Preferably, the one or more organic compounds selected from compounds (1), (2) and (3) are reacted with the polyisocyanate compound in an amount corresponding to 1 to 2 moles of the hydroxyl group per 1 mole of the isocyanate group of the polyisocyanate compound.

Examples of compounds (2) having epoxy and hydroxyl groups may include glycidyl ethers of polyols such as ethylene glycol monoglycidyl ether, glycerol mono- or di-glycidyl ether, and sorbitol polyglycidyl ether; glycidyl ethers of polyoxyethylene ethers (e.g., polyoxyetylene ether, polyoxypropylene ether, and polyoxybutylene ether) of polyols (e.g., ethylene glycol, propylene glycol, and glycerol); and commercially available epoxy resins having hydroxyl groups.

Compounds (1) having quaternary ammonium and hydroxyl groups usable for the present invention may be obtained by quaternizing a compound having tertiary amino and hydroxyl groups with a quaternizing agent. Examples of the compound having tertiary amino and hydroxyl groups may include N,N-dialkylalkanolamines such as N,N-dimethylethanolamine, N,N-diethylpropanolamine, and N-lauryl-N-methylethanolamine; N-alkyldialkanolamines such as N-methyldiethanolamine, N-butyldiethanolamine, and N-stearyldipropanolamine; condensates of N,N-dialkylalkylenediamines, such as N,N-diethylethylenediamine and N,N-dimethylpropylenediamine, and hydroxycarboxylic acids; condensates of N,N-dialkylalkanolamines and hydroxycarboxylic acids; and compounds obtained by adding at least one mole of an alkylene oxide such as ethylene oxide, propylene oxide, or butylene oxide to each active hydrogen atom of an amine such as an alkylamine, dialkylamine, N-alkylaminalkyleneamine, or alkylenediamine having at least one carbon atom.

As examples of the quaternizing agent, there may be mentioned dialkyl sulfates such as dimethyl sulfate and diethyl sulfate, alkyl halides such as methyl chloride, ethyl bromide and butyl bromide, benzyl chloride, methyl toluenesulfonate, and ethylene halohydrins. In the case where a quaternizing agent having one or more hydroxyl groups is used, tertiary amines having no hydroxyl group can also be employed for obtaining compounds (1) having quaternary ammonium and hydroxyl groups.

As examples of polyethers (3), there may be mentioned polyethers having one or more terminal hydroxyl groups and obtained by the addition polymerization of a polyol such as ethylene glycol, propylene glycol, butylene glycol, glycerol, trimethylolpropane, or pentaerythritol and one or more alkylene oxides such as ethylene oxide, propylene oxide, butylene oxide, and/or tetrahydrofuran; alkylene oxide addition polymers of polyphenols such as resorcinol and bisphenols; and alkylene oxide addition polymers of polybasic carboxylic acids such as succinic acid, adipic acid, fumaric acid, maleic acid, glutaric acid, azelaic acid, phthalic acid, terephthalic acid, dimer acid, and pyromellitic acid.

Examples of polyesters (3) may include condensates of polyols and poylbasic carboxylic acids and condensates of polyols and hydroxycarboxylic acids, and as the polyols and polybasic carboxylic acids there may be employed those as mentioned hereinbefore. Further, as the condensates of polyols and hydroxycarboxylic acids, there may be used, for example, the reaction products of castor oil or a castor fatty acid and ethylene glycol or propylene glycol.

As polyesterethers (3), there may be mentioned, for example, alkylene oxide addition polymers of the above-mentioned polyesters and polyesterethers having one or more terminal hydroxyl groups and obtained by the condensation of a polyether and a polybasic carboxylic acid.

Examples of the polyisocyanate compound may include tolylene diisocyanate, naphthalene diisocyanate, phenylene diisocyanate, diphenylmethane diisocyanate, xylylene diisocyanate, and hexamethylene diisocyanate and reaction products thereof with polyols.

The epoxy resin usable for the present invention may include epoxy resins derived from glycidyl ethers of phenols, glycidyl ethers of phenol-form-aldehyde precondensates, vinyl-acrylic acid copolymers, and polybutadiene. Preferably, the epoxy resins have at least two epoxy groups and are not water-dispersible.

Preferably the bundle of continuous carbon filament fibers according to the present invention has a high fretting resistance corresponding to a FW strength of at least 2 kg, more preferably 3 kg, per 6,000 monofilaments of which the carbon fiber bundle is composed, as measured by means of the following method.

METHOD FOR MEASURING FW STRENGTH

A bundle of 6,000 carbon filaments was sized with a predetermined amount of a sizing agent, was heated until dry at 180° C. to 240° C. for 0.5 to 2.0 minutes, and was wound onto a bobbin. The bundle was radially unwound from the bobbin, was dipped into a solution of a "Epikote" 827 (Shell Chemical Co.)/methyl nadic anhydride (1:1) mixture, was removed from the solution, and then was passed through a fretting pin having a diameter of 10 mm and a surface smoothness of 3S while being brought into contact with the fretting pin. The FW strength was determined as the maximum tension in kilograms when the carbon fiber bundle passing through the fretting pin was broken in a case where the unwinding tension of the carbon fiber bundle was gradually increased.

The sizing agent usable for the present invention may preferably contain as an active component a water-dispersible resin composition consisting of about 65% to 75% by weight of the water-dispersible urethane compound and about 25% to 35% by weight of the epoxy resin. The sizing agent may preferably be applied to the carbon fiber bundle, in the form of an aqueous dispersion, to a coverage of about 0.2% to 5% by weight, more preferably 0.3% to 2% by weight, based on the weight of the fibers. If the amount of the epoxy resin is more than 35% by weight, the resultant carbon fiber bundle may have a poor fretting resistance, with the FW strength being less than 2.0 kg/6000 filaments, and the sizing agent itself may have a short pot life. If the amount of the epoxy resin is less than 5% by weight, the sizing agent may have a moisture absorption property high enough to deteriorate the other properties, particularly the inter-laminar shear strength (ILSS) of the composite material wherein the resultant carbon fiber bundle is employed as a reinforcing material. Further, if the coverage of the sizing agent is less than 0.2%, the resultant carbon fiber bundle may have an unsatisfactory fretting resistance and a FW strength of less than 2.0 kg/6000 filaments. On the other hand, if the coverage of the sizing agent is more than 5%, the resultant carbon fiber bundle may be unsatisfactorily handleable, having a poor flexing resistance and too high a coherency.

The bundle of continuous carbon filament fibers according to the present invention may be produced, basically, by dipping a bundle of continuous carbon filament fibers into an aqueous dispersion sizing agent as defined hereinbefore and then drying and heat treating the carbon fiber bundle. However, it is very advantageous, in order to obtain a carbon fiber bundle having a high FW strength of at least 2.0 kg/6000 filaments, if the carbon fiber bundle is subjected to drying and heat treating at 180° C. to 250° C. for 0.5 to 2.0 minutes after it is dipped into the aqueous dispersion sizing agent. If the temperature is lower than 180° C. or the heating time is less than 0.5 minute, a long period of time may be necessary to remove the moisture from the deposited sizing agent, and if the removal of moisture is not satisfactory, the resultant carbon fiber bundle may have a poor adhesiveness in relation to the matrix resin so that the production of a composite material having a good mechanical strength and adhesiveness becomes difficult. On the other hand, if the temperature is higher than 250° C. or the heating time is more than 2 minutes, the sizing agent may be hardly cured so that the resultant carbon fiber bundle has a poor flexing resistance and, thus, is not very handleable.

Thus, the present invention also provides a carbon fiber-reinforced composite material having excellent physical properties, particularly an excellent mechanical strength, and comprising at least one resin matrix and the bundle of continuous carbon filament fibers as defined hereinbefore. Preferred examples of the resin matrix are epoxy resins, unsaturated polyester resins, and phenolic resins.

The bundle of continuous carbon filament fibers according to the present invention has an excellent fretting resistance so that fluffs and yarn breakage are not likely to occur at subsequent processing stages. It also is extremely handleable so as to ensure the effective processing thereof. In particular, in a case where the carbon fiber bundle is inevitably brought into contact with rollers or guides at subsequent processing stages, such as the prepreg formation step in which warping is carried out by means of guides and the step of forming a rotationally shaped article for the shaft of a golf club in which FW is carried out, the occurence of fluffs or yarn breakage in the carbon fiber bundle not only affects deleteriously workability and productivity in the processing stages but also deteriorates the quality of the products. Thus, the carbon fiber bundle of the present invention may be very advantageously utilized practically due to the excellent fretting resistance thereof.

The present invention will further be illustrated below with reference to the following non-limitative examples.

EXAMPLE 1

87 g of an isomeric mixture of 2,4- and 2,6-tolylene diisocyanate at a ratio of 80:20 and 34.3 g of N-methyldiethanolbenzylammonium chloride were added to 260 g of polypropylene glycol having a hydroxyl number of 112 and were reacted together under a nitrogen atmosphere at 40° C. for about 2 hours to obtain a urethane compound containing 2.23% of the isocyanate group and 0.513% of quaternary nitrogen. To the urethane compound, 41.3 g of glycerol diglycidyl ether and 335.4 g of dimethylformamide were added, and they were reacted at 50° C. for about 3 hours until the isocyanate group could no longer be detected. The obtained reaction product contained 0.743% of oxirane oxygen and 0.476% of quaternary nitrogen and had a good water-dispersibility.

To the obtained polyurethane, a solution of a liquid epoxy resin of the bisphenol A diglycidyl ether type ("Epikote" 834, manufactured by Shell Chemical Co.) having an epoxy equivalent of 225 to 280, an average molecular weight of about 470, and a specific gravity of about 1.1 in dimethylformamide (DMF) was added and then water was added to obtain six aqueous dispersions of epoxy-modified polyurethane of different compositions as shown in Table 1 below.

TABLE 1

| Run No. | Epoxy resin (% by weight) | Poly urethane (% by weight) | Amount of resin mixture (%) | Amount of water (%) | Amount of DMF (%) |
|---|---|---|---|---|---|
| 1 | 0 | 5 | 100 | 93 | 2 |

TABLE 1-continued

| Run No. | Epoxy resin (% by weight) | Poly urethane (% by weight) | Amount of resin mixture (%) | Amount of water (%) | Amount of DMF (%) |
|---|---|---|---|---|---|
| 2 | 0.25 | 4.75 | 95 | 93 | 2 |
| 3 | 1.0 | 4.0 | 80 | 93 | 2 |
| 4 | 1.5 | 3.5 | 70 | 93 | 2 |
| 5 | 2.0 | 3.0 | 60 | 93 | 2 |
| 6 | 2.5 | 2.5 | 50 | 93 | 2 |

A bundle of continuous carbon filament fibers of 6,000 deniers/6,000 filaments was padded using each of the six dispersions to such a pick up that the coverage of the epoxy-modified polyurethane was 1%. Then the bundle was heat treated at 200° C. for 1 minute and the FW strength of the resultant carbon fiber bundle was measured.

The obtained carbon fiber bundle was converted into a composite, using as the matrix resin an unsaturated polyester resin ("Polmal" 8225 P containing benzoyl peroxide as a polymerization initiator; manufactured by Takeda Pharmaceutical Co.) or an epoxy resin ("Epikote" 828, containing $BF_3$-monoethylamine complex as a catalyst; manufactured by Shell Chemical Co.). Then the ILSS of the obtained composite was measured. The results are shown in Table 2 below.

TABLE 2

| Run No. | FW strength (kg) | ILSS ($kg/mm^2$) Unsaturated polyester | ILSS ($kg/mm^2$) Epoxy resin |
|---|---|---|---|
| 1 | 6.0 | Impossible to measure | 7.5 |
| 2 | 6.0 | 2.5 | 8.5 |
| 3 | 5.0 | 5.5 | 9.0 |
| 4 | 4.0 | 7.0 | 9.0 |
| 5 | 2.0 | 7.0 | 9.0 |
| 6 | 1.0 | 7.0 | 9.0 |

EXAMPLE 2

The procedure in Run No. 4 of Example 1 was repeated, except that the coverage of the epoxy-modified polyurethane on the carbon fiber bundle was varied, and the FW strength of the resultant bundle was measured. The results are shown in Table 3 below.

TABLE 3

| Run No. | Coverage of epoxy-modified polyurethane (% by weight) | FW strength (kg) |
|---|---|---|
| 7 | 0 | 0.5 |
| 8 | 0.5 | 2.0 |
| 9 | 1.0 | 4.0 |
| 10 | 2.0 | 6.0 |
| 11 | 3.0 | 6.0 |

We claim:

1. A bundle of continuous carbon filament fibers treated with a sizing agent containing as an active component a water-dispersible resin composition consisting of about 65% to 95% by weight of a water-dispersible urethane compound having at least one epoxy group and at least one quaternary ammonium group and about 5% to 35% by weight an epoxy resin.

2. A bundle of continuous carbon filament fibers according to claim 1, wherein the amounts of the water-dispersible urethane compound and the epoxy resin are about 65% to 75% by weight and about 25% to 35% by weight, respectively.

3. A bundle of continuous carbon filament fibers according to claim 1, wherein the water-dispersible urethane compound is a reaction product of at least one organic compound selected from the group consisting of (1) compounds having quaternary ammonium and hydroxyl groups, (2) compounds having epoxy and hydroxyl groups, and (3) polyesters, polyethers, and polyesterethers having one or more hydroxyl groups and a polyisocyanate compound.

4. A bundle of continuous carbon filament fibers according to claim 3, wherein the water-dispersible urethane compound is a product obtained by reacting at least one compound selected from the compounds (1), (2), and (3) with the polyisocyanate compound in an amount corresponding to 1 to 2 moles of the hydroxyl group per 1 mole of the isocyanate group of the polyisocyanate compound.

5. A bundle of continuous carbon filament fibers according to claim 1, wherein the epoxy resin is selected from the epoxy resins derived from glycidyl ethers of phenols, glycidyl ethers of phenol-formaldehyde precondensates, vinyl-acrylic acid copolymers, and polybutadiene.

6. A bundle of continuous carbon filament fibers according to claim 1, wherein the sizing agent is applied to the carbon filament fiber bundle in an amount of 0.2% to 5% by weight based on the weight of the fibers.

7. A bundle of continuous carbon filament fibers according to claim 6, wherein the amount of the sizing agent is 0.3% to 2% by weight.

8. A bundle of continuous carbon filament fibers according to claim 1 comprised of at least 500 monofilaments having a diameter of about 5 to 20 μm.

9. A bundle of continuous carbon filament fibers according to claim 8 comprised of 500 to 50,000 monofilaments having a diameter of about 5 to 8 μm.

10. A bundle of continuous carbon filament fibers according to any one of claims 1 through 9 having a filament winding strength of at least 2 kg per 6,000 monofilaments of which the carbon fiber bundle is composed.

11. A carbon fiber-reinforced composite material which comprises at least one resin matrix and the bundle of continuous carbon filament fibers as defined in claim 1.

12. A carbon fiber-reinforced composite material according to claim 11, wherein the resin matrix is at least one resin selected from the group consisting of epoxy resins, unsaturated polyester resins, and phenolic resins.

* * * * *